US006575245B2

(12) United States Patent
Hurst et al.

(10) Patent No.: US 6,575,245 B2
(45) Date of Patent: Jun. 10, 2003

(54) APPARATUS AND METHODS FOR GRAVEL PACK COMPLETIONS

(75) Inventors: Gary D. Hurst, Lake Jackson, TX (US); Raymond J. Tibbles, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 169 days.

(21) Appl. No.: 09/779,861

(22) Filed: Feb. 8, 2001

(65) Prior Publication Data

US 2002/0104655 A1 Aug. 8, 2002

(51) Int. Cl.[7] ..... E21B 43/04
(52) U.S. Cl. ..... 166/278; 166/51; 166/227
(58) Field of Search ..... 166/278, 51, 50, 166/227, 230, 233

(56) References Cited

U.S. PATENT DOCUMENTS

| | | | | | |
|---|---|---|---|---|---|
| 1,276,213 | A | * | 8/1918 | Hare | 166/227 |
| 3,556,219 | A | | 1/1971 | Meldau | |
| 4,553,595 | A | * | 11/1985 | Huang et al. | 166/278 |
| 4,558,742 | A | * | 12/1985 | Huang et al. | 166/278 |
| 5,107,927 | A | | 4/1992 | Whiteley et al. | |
| 5,355,948 | A | | 10/1994 | Sparlin et al. | |
| 5,355,949 | A | * | 10/1994 | Sparlin et al. | 166/236 |
| 5,450,898 | A | * | 9/1995 | Sparlin et al. | 166/227 |
| 5,934,376 | A | | 8/1999 | Nguyen et al. | |
| 6,220,345 | B1 | | 4/2001 | Jones et al. | |
| 6,227,303 | B1 | | 5/2001 | Jones | |
| 2002/0079099 | A1 | * | 6/2002 | Hurst et al. | 166/278 |

* cited by examiner

*Primary Examiner*—Hoang Dang
(74) *Attorney, Agent, or Firm*—Williams, Morgan & Amerson PC; Jeffrey Griffin; Brigitte Jeffery

(57) ABSTRACT

This invention provides improved apparatus and methods for completing a subterranean zone penetrated by a wellbore utilizing a gravel pack operation. One embodiment of the invention is an apparatus for completing a subterranean zone penetrated by a wellbore comprising a tubular member having a wall and a longitudinal bore. A plurality of apertures extend through the tubular member wall, the apertures define at least one radial arc and create at least one perforated radial aperture zone and at least one non-perforated radial blank zone. A screen member is attached to the exterior of the tubular member that covers the apertures. The placement of the apparatus within the wellbore creates an annular flow region that has a reduced tendency for premature dehydration of slurry during a gravel pack completion operation.

37 Claims, 3 Drawing Sheets

APPARATUS AND METHODS FOR GRAVEL PACK COMPLETIONS

BACKGROUND OF THE INVENTION

1. Field of the Invention

This invention relates generally to tools used to complete subterranean wells and more particularly relates to apparatus and methods for use in performing gravel pack operations.

2. Description of Related Art

Hydrocarbon fluids such as oil and natural gas are obtained from a subterranean geologic formation, referred to as a reservoir, by drilling a well that penetrates the hydrocarbon-bearing formation. Once a wellbore has been drilled, the well must be completed before hydrocarbons can be produced from the well. A completion involves the design, selection, and installation of equipment and materials in or around the wellbore for conveying, pumping, or controlling the production or injection of fluids. After the well has been completed, production of oil and gas can begin.

Sand or silt flowing into the wellbore from unconsolidated formations can lead to an accumulation of fill within the wellbore, reduced production rates and damage to subsurface production equipment. Migrating sand has the possibility of packing off around the subsurface production equipment, or may enter the production tubing and become carried into the production equipment. Due to its highly abrasive nature, sand contained within production streams can result in the erosion of tubing, flowlines, valves and processing equipment. The problems caused by sand production can significantly increase operational and maintenance expenses and can lead to a total loss of the well.

One means of controlling sand production is the placement of relatively large sand (i.e., "gravel") around the exterior of a slotted, perforated, or other type liner or screen. The gravel serves as a filter to help assure that formation fines and sand do not migrate with the produced fluids into the wellbore. In a typical gravel pack completion, a screen is placed in the wellbore and positioned within the unconsolidated formation that is to be completed for production. The screen is typically connected to a tool that includes a production packer and a cross-over, and the tool is in turn connected to a work or production tubing string. The gravel is mixed with a carrier fluid and is pumped in a slurry down the tubing and through the cross-over, thereby flowing into the annulus between the screen and the wellbore. The carrier fluid in the slurry leaks off into the formation and/or through the screen. The screen is designed to prevent the gravel in the slurry from flowing through it and entering the production tubing. As a result, the gravel is deposited in the annulus around the screen where it forms a gravel pack. It is important to size the gravel for proper containment of the formation sand, and the screen must be designed in a manner to prevent the flow of the gravel through the screen.

A problem that is frequently encountered in a gravel pack completion, especially in long or highly deviated sections, is the formation of gravel bridges in the annulus between the wellbore and the tubing string. Non-uniform gravel packing of the annulus between the screen and the wellbore often occurs as a result of the premature loss of carrier fluid from the slurry. The fluid can be lost into high permeability zones within the formation, leading to the creation of gravel bridges in the annulus before all the gravel has been placed. These gravel bridges can further restrict the flow of slurry through the annulus, which can result in voids within the gravel pack. Once the well is placed on production, the flow of produced fluids will be concentrated through any voids in the gravel pack, which can result in the migration of fines and sand into the produced fluids and lead to the problems discussed above.

There is a need for improved tools and methods to avoid premature dehydration of the gravel pack slurry and minimize the creation of gravel bridges and voids during a gravel pack completion of a wellbore.

SUMMARY OF THE INVENTION

This invention provides improved apparatus and methods for completing a subterranean zone penetrated by a wellbore.

One embodiment of the invention is an apparatus comprising a tubular member having a wall and a longitudinal bore. There are a plurality of radial apertures through the tubular member wall, the apertures defining at least one radial arc and creating at least one perforated radial aperture zone and at least one non-perforated radial blank zone. A screen member is attached to the exterior of the tubular member that covers the apertures. The screen member can comprise a filtering mechanism that will prevent the passage of gravel particulate matter while allowing the communication of fluids. The screen member can comprise a filtering mechanism such as a continuous wire wrapped in a spiral configuration, a plurality of elongate bars spaced longitudinally about the exterior of the tubular member, a wire mesh, or a slotted sleeve element. Any of these embodiments can also include a spacer that forms a fluid flow annulus between the screen member and the tubular member apertures. The screen member can be located within the radial arc of the tubular wall in which the apertures are located. The screen member can enclose the radial arc of the tubular member wall in which the apertures are located. The placement of the radial blank zone into the wellbore can create an annular flow region. The tubular member can further comprise an offset device to enable the eccentric placement of the sand screen within the wellbore. The eccentric placement of the sand screen within the wellbore can create an annular flow region.

An alternate embodiment of the invention consists of a sand screen that comprises a base tubular having at least one perforated radial aperture zone and at least one non-perforated radial blank zone and a screen attached to the base tubular that covers the radial aperture zone. The screen can comprise apertures that allow fluid to pass therethrough, but are small enough to prevent the flow of a gravel particulate. The screen can comprise a filtering mechanism such as a continuous wire wrapped in a spiral configuration, a plurality of elongate bars spaced longitudinally about the exterior of the tubular member, a wire mesh, or a slotted sleeve element. The sand screen can further comprise an offset device to enable the eccentric placement of the sand screen within a wellbore. The eccentric placement of the sand screen within the wellbore can create an annular flow region.

Another embodiment is a well completion comprising a production tubing having at least one sand screen in fluid communication with the production tubing. The sand screen can comprise a base tubular having at least one perforated radial aperture zone and at least one non-perforated radial blank zone and at least one screen attached to the base tubular that covers the radial aperture zone. The screen comprises apertures that allow fluid to pass but are small enough to prevent the flow of a gravel particulate. The screen can comprise a filtering mechanism such as a continuous wire wrapped in a spiral configuration, a plurality of elongate bars spaced longitudinally about the exterior of the tubular member, a wire mesh, or a slotted sleeve element. The sand screen can further comprise an offset device to enable the eccentric placement of the at least one sand screen within a wellbore. The eccentric placement of the sand screen within the wellbore can create an annular flow region.

Yet another embodiment is a well completion comprising a wellbore casing with at least one perforation, the perforations being located around the circumference of the casing by a perforation phasing and orientation. The well completion includes a production tubing having at least one perforated radial aperture zone and at least one non-perforated radial blank zone and the production tubing is positioned within the wellbore creating an annular flow region. The production tubing can further comprise a screen element that covers the perforated radial aperture zone. The perforations in the wellbore casing can be selectively placed by controlling the perforation phasing and orientation. The radial aperture zone and the radial blank zone can be created by selectively perforating the production tubing. An annular flow region can be created by aligning the radial aperture zone and the radial blank zone with the perforations of the wellbore casing. An annular flow region can also be created by positioning the production tubing in an eccentric location relative to the wellbore casing. The radial aperture zone can be radially aligned with perforations of the wellbore casing.

A further embodiment of the present invention is a method of completing a well by providing a sand screen in the well and creating an annular flow region adjacent to the sand screen. The method can further comprise perforating the wellbore casing in a predetermined phasing arrangement to create well perforations, providing at least one non-perforated radial blank zone of the sand screen, and orienting the radial blank zone relative to the well perforations. An annular flow region can be created by positioning the sand screen in an eccentric location relative to the wellbore casing. An annular flow region can also be created by aligning the sand screen in relation to the wellbore casing perforations such that the radial blank zone is not adjacent to a well perforation.

Yet another embodiment is a method of completing a wellbore that includes placing within the wellbore to be completed: (i) an apparatus that comprises a tubular member having a wall and a longitudinal bore, (ii) at least one aperture through the tubular member wall, the at least one aperture defining at least one radial arc and creating at least one perforated radial aperture zone and at least one non-perforated radial blank zone, and (iii) a screen member attached to the exterior of the tubular member that covers the apertures. A fluid comprising gravel particulate matter is injected into the annulus between the wellbore and tubular member, whereby the gravel particulate matter is placed within the annulus between the tubular member and the wellbore wall. The screen member can comprise a filtering mechanism that will prevent the passage of gravel particulate matter while allowing the communication of fluids therethrough. The wellbore can have a cylindrical casing having a plurality of radial perforations, and the method can further comprise positioning the apparatus such that the apertures of the tubular member are radially aligned with the wellbore perforations. An annular flow region can be created by positioning the tubular member in an eccentric location relative to the cylindrical casing.

In still another embodiment a method of completing a wellbore that comprises a cylindrical casing is claimed. The method comprises perforating the casing with at least one perforation, the perforations being located around the circumference of the casing by a perforation phasing. An apparatus is placed within the wellbore that comprises: (i) a tubular member having a wall and a longitudinal bore, (ii) at least one aperture through the tubular member wall, the at least one aperture defining at least one radial arc and creating at least one perforated radial aperture zone and at least one non-perforated radial blank zone, and (iii) a screen member attached to the exterior of the tubular member that covers the apertures. The apparatus is positioned such that the apertures of the tubular member are radially aligned with the wellbore perforations. A fluid comprising gravel particulate matter is injected into the annulus between the wellbore and tubular member whereby the gravel particulate matter is placed within the annulus between the tubular member and the wellbore wall.

The radial apertures through the wall of the tubular member define a radial aperture zone with an aperture zone midpoint and a radial blank zone with a blank zone midpoint. The apparatus can be aligned in relation to the wellbore perforations such that the blank zone midpoint is not adjacent to a wellbore perforation. The apparatus can also be aligned in relation to the wellbore perforations such that the radial distance between the blank zone midpoint and the nearest wellbore perforation is maximized. An annular flow region can be created by positioning the tubular member in an eccentric location relative to the cylindrical casing.

DESCRIPTION OF ILLUSTRATIVE EMBODIMENTS

Figure 1A:
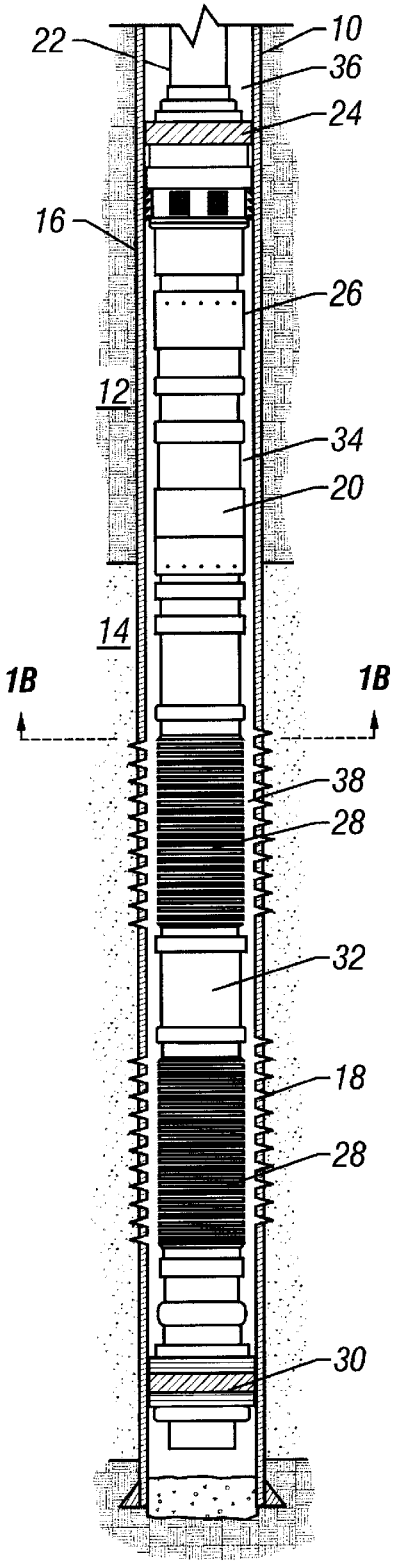
FIG. 1A (Prior Art)
FIG. 1A is an illustration of a wellbore showing a typical gravel pack completion apparatus. This illustration is of prior art.

Referring to the attached drawings, FIG. 1A illustrates a typical gravel pack completion in which a wellbore 10 has penetrated a subterranean zone 12 that includes a productive formation 14. The wellbore 10 has a casing 16 that has been cemented in place. The casing 16 has a plurality of perforations 18 which allow fluid communication between the wellbore 10 and the productive formation 14. A well tool 20 is positioned within the casing 16 in a position adjacent productive formation 14, which is to be gravel packed.

The well tool 20 comprises a tubular member 22 attached to a production packer 24, a cross-over 26, one or more screen members 28 and optionally a lower packer 30. Blank sections 32 of pipe may be used to properly space the relative positions of each of the components. An annulus area 34 is created between each of the components and the wellbore casing 16.

In a typical gravel pack operation the packer elements 24, 30 are set to ensure a seal between the tubular member 22 and the casing 16. Gravel laden slurry is pumped down the tubular member 22, exits the tubular member through ports in the cross-over 26 and enters the annulus area 34. In one typical embodiment the particulate matter (gravel) in the slurry has an average particle size between about 40/60–12/20 mesh, although other sizes may be used. Slurry dehydration occurs when the carrier fluid leaves the slurry. One way the carrier fluid can leave the slurry is by way of the perforations 18 and entering into the formation 14. The carrier fluid can also leave the slurry by way of the screen member 28 and entering the tubular member 22. The carrier fluid entering through the screen member 28 flows up through the tubular member 22 until the cross-over 26 places it into the annulus area 36 above the production packer 24, where it can be circulated to the surface. With proper slurry dehydration the gravel grains should be deposited within the annulus area 34 and pack tightly together. The final gravel filled annulus area is referred to as a gravel pack.

As used herein, the term "screen" refers to wire wrapped screens, mechanical type screens and other filtering mechanisms typically employed with sand screens. Sand screens need to have openings small enough to restrict gravel flow, often having gaps in the 60–120 mesh range, but other sizes may be used. The screen element 28 can be referred to as a sand screen or a gravel pack screen. Many of the common screen types include a spacer that offsets the screen member from a perforated base tubular that the screen member surrounds. The spacer provides a fluid flow annulus between the screen member and the base tubular. Screens of various types are produced by US Filter/Johnson Screen, among others, and are commonly known to those skilled in the art.

As can be seen in FIG. 1A, the annulus area 38 between the screen member 28 and the casing perforations 18 has multiple fluid flow paths for slurry dehydration. A premature dehydration of the slurry can result in a gravel bridge being formed within the annulus area 38 adjacent to the screen member 28. When a gravel bridge is formed, an incomplete gravel pack will result below the bridge leaving void areas within the gravel pack. A complete gravel pack is necessary to prevent formation sand from migrating from the productive formation 14 into the wellbore annulus 34 and possibly undermining the entire well completion.

Figure 1B:
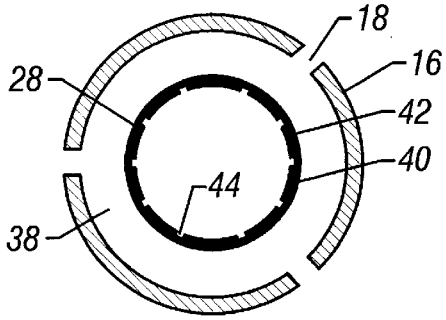
FIG. 1B (Prior Art)
FIG. 1B is a cross section view of a screen element that is section A—A of FIG. 1A. This illustration is of prior art.

As shown in FIG. 1B, the typical screen member 28 comprises radial apertures 44 around the entire circumference of a base tubular 40 and a screen element 42 that wraps around the entire circumference of the base tubular 40. The illustration in FIG. 1B shows the casing 16 having perforations 18 with a perforation phasing of 120 degrees, therefore three perforations within the 360 degree circumference. In other words, each perforation is separated radially from the next perforation in the same plane by about 120 degrees. FIGS. 1A and 1B are illustrations of the prior art.

The present invention involves steps to control the dehydration of the slurry in an effort to minimize premature dehydration and the formation of gravel bridges. Using the present invention in a wellbore creates an area within the casing-tubing annulus that is located significantly further from potential drainage fluid flow paths than other areas of the casing-tubing annulus. This area of reduced drainage is herein referred to as the annular flow region.

Figure 2A:
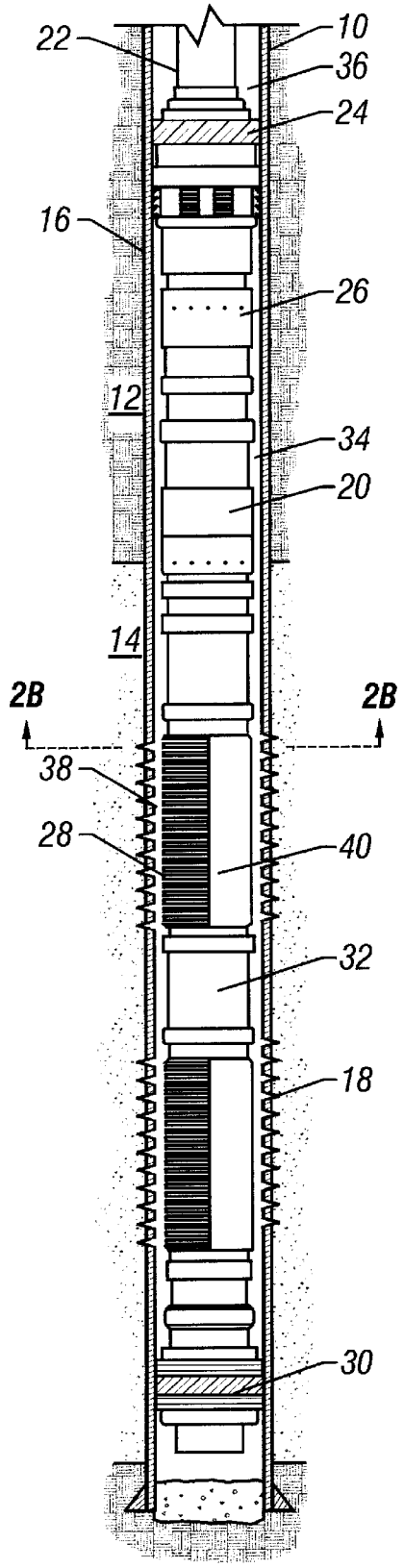
FIG. 2A is an illustration of a wellbore showing a gravel pack completion apparatus comprising the present invention.
Figure 2B:
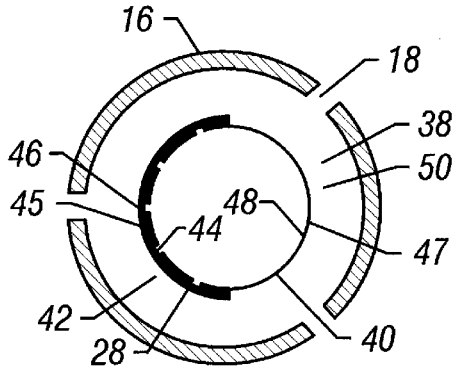
FIG. 2B is a cross section view of a screen element comprising the present invention that is section A—A of FIG. 2A.

Referring to FIG. 2B, in the embodiment of the present invention shown, the base tubular 40 comprises apertures 44 located within a radial arc of no more than about 270 degrees. However, the range of radial arc to which the perforations may be applied can be greater or less than 270 degrees depending upon the particular requirement of the completion. A screen element 42 is attached to the exterior of the base tubular 40 and covers the apertures 44. The portion of the base tubular containing apertures is referred to as the radial aperture zone 45. Midway within the radial aperture zone 45 is the aperture zone midpoint 46. The portion of the base tubular 40 not containing apertures is referred to as the radial blank zone 47. Midway within the radial blank zone 47 is the blank zone midpoint 48. The slurry located within the annulus area adjacent to the radial blank zone 47 will have fewer fluid flow paths available to it and therefore will have less tendency to dehydrate prematurely as compared to the slurry located within the annulus area adjacent to the radial aperture zone 45. When placing the gravel laden slurry within the wellbore annulus 34, the radial blank zone 47 will suppress the slurry dehydration through the screen member 28, which in turn will lessen the chances of premature dehydration. By decreasing the occurrence of premature dehydration, the formation of gravel bridges will be minimized. This will enable a more consistent gravel pack placement that has fewer gravel bridges and void areas than would otherwise exist.

When the radial blank zone 47 is adjacent to a radial section of casing without perforations, a zone having even further reduced slurry dehydration is formed that is called an annular flow region 50. FIG. 2B illustrates a situation where the radial blank zone 47 comprises an arc of about 180 degrees and the casing 16 has perforations 18 with 120 degree phasing. An annular flow region 50 is created in the annular area between the radial blank zone 47 and the approximately 120 degree radial arc of non-perforated casing 16.

In one embodiment of the present invention, the blank zone midpoint 48 is aligned with the casing perforations 18 in order to maximize the distance between the blank zone midpoint 48 and the nearest perforation 18. This type of alignment will result in the largest annular flow region 50 possible. For a wellbore with perforations with 120 degree phasing for example, the location for the blank zone midpoint 48 providing the largest blank area would be midway between two of the perforations. This would give a radial arc of about 60 degrees between the blank zone midpoint 48 and each of the perforations.

Methods of aligning the well tool 20 within the casing 16 can include performing the perforating and gravel pack operations on the same trip in the well. Another method can comprise a lower packer 30 assembly that includes an orienting slot. Both the perforation of the casing and the gravel pack operations can achieve the desired radial alignment by using the same orienting slot. The lower packer 30 containing the orienting slot is first set, then the perforating tool assembly and the gravel pack well tool 20 can be run on separate trips in the well. As long as each assembly contains a guiding tool to mate with the orienting slot, the alignments of the casing perforations 18 and the well tool 20 can be controlled. Yet other possible methods can include an orienting key that is part of the casing 16 or an orienting gyro mechanism. Another method of orienting is by using the natural orientation effect that is observed when similar tubular strings are run into a well. Tubular strings that are similar in size and weight will have similar rotational effects when run into the same well. Therefore if the tubular string used to perforate the well is similar to the tubular string used to gravel pack the well, it can be assumed that the two strings will have similar rotational effects. These examples are not intended to be construed as a comprehensive list of the methods that are available for radial alignment. Other methods for achieving radial alignment can be employed without imposing any limitation onto the claims of the present invention.

One method that can be used to create an annular flow region 50 is to place the well tool 20 in an eccentric location in relation to the casing 16. This can be accomplished by attaching an offset device to the well tool 20. The offset device can be similar to a casing centralizer that is used to center the casing string within the wellbore prior to cementing. The typical centralizer comprises four or more bow spring elements spaced around the circumference that act to space the casing from the wellbore wall. An offset device that is similar to a centralizer, but with the bow springs removed on one side, will urge the well tool towards the casing 16 on the side where the bow springs are removed. This is just one example of a method to eccentrically locate the well tool 20 within the casing 16 and is not intended to be a comprehensive listing or limit the present invention in any way.

Referring to FIG. 2A, in a gravel pack operation utilizing the present invention the packer elements 24, 30 are set to ensure a seal between the tubular member 22 and the casing 16. Gravel laden slurry is pumped down the tubular member 22, exits the tubular member through ports in the crossover 26 and enters the annulus area 34. Slurry dehydration occurs when the carrier fluid leaves the slurry. The carrier fluid can leave the slurry through the perforations 18 and by way of the screen elements 28. Fluid can flow through the screen element 28 and enter the tubular member 22. The carrier fluid then flows up through the tubular member 22 until the crossover 26 places it in the annulus area 36 above the production packer 24 where it can leave the wellbore 10 at the surface. As can be seen in FIG. 2B, the present invention creates an annular flow region 50 that will help eliminate premature slurry dehydration by restricting the flow of carrier fluid through the screen element 28. This will facilitate a more uniform dehydration of the slurry and minimize the occurrence of gravel bridging and the formation of voids within the gravel pack. Upon slurry dehydration the gravel grains should pack tightly together. The final gravel filled annulus area is referred to as a gravel pack.

FIGS. 3A–3D illustrate alternate embodiments of how the alignment of the perforations 18 and the well tool can be used to create one or more annular flow region 50. The casing 16 can be perforated with a certain perforation phasing and orientation. A gravel pack well tool 20 can then be radially oriented such that the location of the radial aperture zones 45 will be aligned in relation to the perforations 18. This will locate the radial blank zones 47 where they will be adjacent to the areas of casing that do not contain perforations. The alignment of the radial blank zones 47 with the areas of the casing that do not have perforations will create an annular flow region 50 that is located significantly further away from drainage fluid flow paths than other areas of the casing-tubing annulus. The annular flow region 50 that is created will have a reduced tendency for fluid drainage and will therefore minimize the risk of premature dehydration of the gravel pack slurry. By minimizing the occurrence of premature dehydration of the gravel pack slurry, the present invention will thereby reduce the incidence of gravel bridges and voids within the resulting gravel pack completion.

Figure 3A:
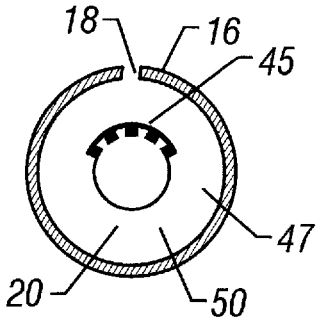
FIGS. 3A–3F are cross section views of different embodiments of the present invention.
Figure 3B:
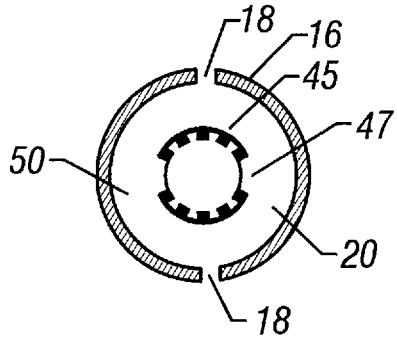
Figure 3C:
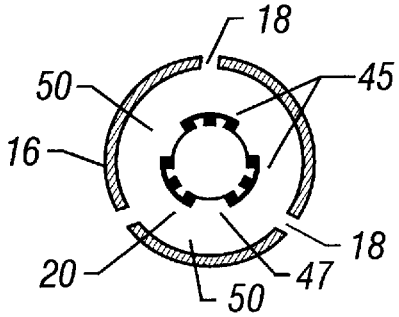
Figure 3D:
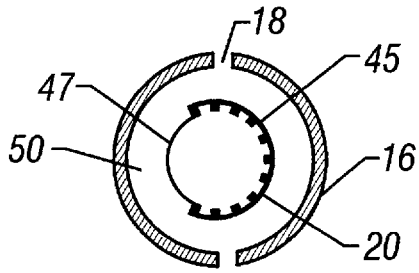
Figure 3E:
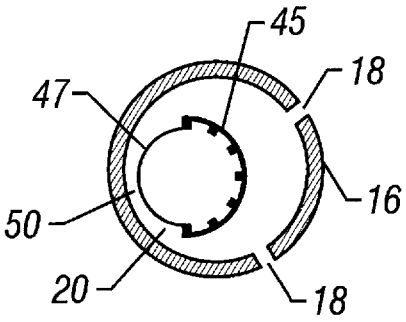
Figure 3F:
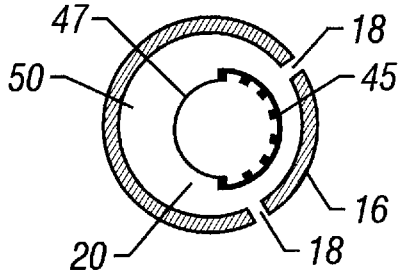

FIGS. 3E and 3F illustrate embodiments of the present invention in which the well tool 20 is eccentrically located in relation to the casing 16.

The discussion and illustrations within this application refer to a vertical wellbore having casing cemented in place and comprising casing perforations to enable communication between the wellbore and the productive formation. The present invention can also be utilized to complete wells that are not cased and likewise to wellbores that have an orientation that is deviated from vertical.

The particular embodiments disclosed herein are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. An apparatus for completing a subterranean zone penetrated by a wellbore comprising:

at least one perforation in a wellbore;

a tubular member located in the wellbore and having a wall and a longitudinal bore;

a plurality of apertures through the tubular member wall, the apertures defining at least one radial arc and creating at least one perforated radial aperture zone and at least one non-perforated radial blank zone; and a screen member attached to the exterior of the tubular member that covers the apertures;

wherein there is no perforation in the wellbore in en arc of at least about 120 degrees adjacent to the at least one non-perforated radial blank zone.

2. The apparatus of claim 1, wherein the screen member comprises a filtering mechanism that will prevent the passage of gravel particulate matter while allowing the communication of fluids therethrough.

3. The apparatus of claim 1, wherein the screen member comprises a filtering mechanism selected from the group consisting of a continuous wire wrapped in a spiral configuration, a plurality of elongate bars spaced longitudinally about the exterior of the tubular member, a wire mesh, and a slotted sleeve element.

4. The apparatus of claim 1, further comprising a spacer to form a fluid flow annulus between the screen member and the tubular member apertures.

5. The apparatus of claim 1, wherein the screen member is located within the at least one radial arc of the tubular wall in which the apertures are located.

6. The apparatus of claim 1, wherein the screen member encloses the at least one radial arc of the tubular member wall in which the apertures are located.

7. The apparatus of claim 1, wherein the tubular member further comprises an offset device to enable an eccentric placement of the tubular member within the wellbore.

8. The apparatus of claim 1, wherein an annular flow region exists between the non-perforated arc of the wellbore and the adjacent non-perforated radial blank zone of the tubular member.

9. The apparatus of claim 7, wherein eccentric placement of the tubular member within the wellbore creates an annular flow region.

10. A sand screen, comprising:

at least one perforation in a wellbore;

a base tubular located within the wellbore and having at least one perforated radial aperture zone and at least one non-perforated radial blank zone; and a screen attached to the base tubular that covers the at least one radial aperture zone;

wherein there is no perforation in the wellbore in an arc of at least about 120 degrees adjacent to the at least one non-perforated radial blank zone.

11. The sand screen of claim 10, wherein the screen comprises apertures that allow fluid to pass therethrough, but are small enough to prevent the flow of a gravel particulate therethough.

12. The sand screen of claim 11, wherein the screen comprises a filtering mechanism selected from the group consisting of a continuous wire wrapped in a spiral configuration, a plurality of elongate bars spaced longitudinally about the exterior of the tubular member, a wire mesh, and a slotted sleeve element.

13. The sand screen of claim 10, wherein the sand screen further comprises an offset device to enable an eccentric placement of the sand screen within a wellbore.

14. The sand screen of claim 13, wherein the eccentric placement of the sand screen within the wellbore creates an annular flow region.

15. A well completion, comprising: at least one perforation in a wellbore;

a production tubing located within the wellbore and having at least one sand screen in fluid communication therewith;

the at least one sand screen comprising;

a base tubular having at least one perforated radial aperture zone and at least one non-perforated radial blank zone; and at least one screen attached to the base tubular that covers the at least one radial aperture zone;

wherein there is no perforation in the wellbore in an arc of at least about 120 degrees adjacent to the at least one non-perforated radial blank zone.

16. The well completion of claim 15, wherein the at least one screen comprises apertures that allow fluid to pass but are small enough to prevent the flow of a gravel particulate therethough.

17. The well completion of claim 15, wherein the at least one screen comprises a filtering mechanism selected from the group consisting of a continuous wire wrapped in a spiral configuration, a plurality of elongate bars spaced longitudinally about the exterior of the tubular member, a wire mesh, and a slotted sleeve element.

18. The well completion of claim 15, wherein the at least one sand screen further comprises an offset device to enable an eccentric placement of the at least one sand screen within a wellbore.

19. The well completion of claim 18, wherein the eccentric placement of the at least one sand screen within the wellbore creates an annular flow region.

20. A well completion, comprising:

a wellbore casing with at least one perforation, the at least one perforation being located around the circumference of the casing by a perforation phasing and orientation;

a production tubing having at least one perforated radial aperture zone and at least one non-perforated radial blank zone; and the production tubing positioned within the wellbore such that there is no perforation in the casing in an arc of at least about 120 degrees that is adjacent to the at least one non-perforated radial blank zone, creating an annular flow region between the casing and the radial blank zone of the production tubing.

21. The well completion of claim 20, wherein the production tubing further comprises a screen element that covers the at least one perforated radial aperture zone.

22. The well completion of claim 21, wherein the at least one perforation in the wellbore casing is selectively placed by controlling the perforation phasing and orientation.

23. The well completion of claim 22, wherein the at least one radial aperture zone and the at least one radial blank zone are created by selectively perforating the production tubing.

24. The well completion of claim 23, wherein the annular flow region is created by aligning the at least one perforated radial aperture zone and the at least one radial blank zone with the at least one perforation of the wellbore casing.

25. The well completion of claim 23, wherein the annular flow region is created by positioning the production tubing in an eccentric location relative to the wellbore casing.

26. The well completion of claim 25, wherein the radial aperture zone is radially aligned with the at least one perforation of the wellbore casing.

27. A method of completing a cased wellbore, comprising:

perforating the wellbore casing in a predetermined phasing arrangement to create well perforations;

providing a sand screen having at least one non-perforated radial blank zone in the well;

gravel packing the well using a gravel pack slurry;

orienting the at least one non-perforated radial blank zone relative to the well perforations to control dehydration of the gravel slurry by forming an annular flow region adjacent to the sand screen.

28. The method of claim 27, wherein the annular flow region is created by positioning the sand screen in an eccentric location relative to the wellbore casing.

29. The method of claim 27, wherein the annular flow region is created by aligning the sand screen in relation to the wellbore casing perforations such that the radial blank zone is not adjacent to a well perforation.

30. A method of completing a wellbore that has at least one perforation therein, comprising:

placing within the wellbore to be completed an apparatus that comprises (i) a tubular member having a wall and a longitudinal bore, (ii) at least one aperture through the tubular member wall, the at least one aperture defining at least one radial arc and creating at least one perforated radial aperture zone and at least one non-perforated radial blank zone, and (iii) a screen member attached to the exterior of the tubular member that covers the apertures;

wherein there is no perforation in the wellbore in an arc of at least about 120 degrees adjacent to the at least one non-perforated radial blank zone; and injecting a fluid comprising gravel particulate matter into the annulus between the wellbore and tubular member, whereby the gravel particulate matter is placed within the annulus between the tubular member and the wellbore wall.

31. The method of claim 30, wherein the screen member comprises a filtering mechanism that will prevent the passage of gravel particulate matter while allowing the communication of fluids therethrough.

32. The method of claim 30, wherein the wellbore further comprises a cylindrical casing having a plurality of radial perforations therethrough, and the method further comprises positioning the apparatus such that the apertures of the tubular member are radially aligned with the wellbore perforations.

33. The method of claim 32, whereby an annular flow region is created by positioning the tubular member in an eccentric location relative to the cylindrical casing.

34. A method of completing a wellbore that comprises a cylindrical casing comprising:

perforating the casing with at least one perforation, the at least one perforation being located around the circumference of the casing by a perforation phasing;

placing within the wellbore to be completed an apparatus that comprises (i) a tubular member having a wall and a longitudinal bore, (ii) at least one aperture through the tubular member wall, the at least one aperture defining at least one radial arc and creating at least one perforated radial aperture zone and at least one non-perforated radial blank zone, and (iii) a screen member attached to the exterior of the tubular member that covers the apertures;

positioning the apparatus such that the apertures of the tubular member are radially aligned with the casing perforations such that there is no perforation in the casing in an arc of at least about 120 degrees adjacent to the at least one non-perforated radial blank zone; and injecting a fluid comprising gravel particulate matter into the annulus between the wellbore and tubular member whereby the gravel particulate matter is placed within the annulus between the tubular member and the wellbore wall.

35. The method of claim 34, wherein the at least one radial aperture through the wall of the tubular member define a radial aperture zone with an aperture zone midpoint and a radial blank zone with a blank zone midpoint, and the apparatus is aligned in relation to the wellbore perforations such that the blank zone midpoint is not adjacent to a wellbore perforation.

36. The method of claim 35, wherein the apparatus is aligned in relation to the wellbore perforations such that the radial distance between the blank zone midpoint and the nearest wellbore perforation is maximized.

37. The method of claim 34, whereby an annular flow region is created by positioning the tubular member in an eccentric location relative to the cylindrical casing.

* * * * *